US009265390B2

(12) United States Patent
Dillard

(10) Patent No.: US 9,265,390 B2
(45) **Date of Patent: *Feb. 23, 2016**

(54) TOILET SEAL SYSTEM

(71) Applicant: Sandra Eileen Dillard, Tarpon Springs, FL (US)

(72) Inventor: Sandra Eileen Dillard, Tarpon Springs, FL (US)

( * ) Notice: Subject to any disclaimer, the term of this patent is extended or adjusted under 35 U.S.C. 154(b) by 64 days.

This patent is subject to a terminal disclaimer.

(21) Appl. No.: 14/057,050

(22) Filed: Oct. 18, 2013

(65) Prior Publication Data

US 2014/0215699 A1 Aug. 7, 2014

(51) Int. Cl.

| | |
|---|---|
| ***A47K 17/02*** | (2006.01) |
| ***A47K 13/04*** | (2006.01) |
| *E03F 9/00* | (2006.01) |

(52) U.S. Cl.

CPC ..... *A47K 17/02* (2013.01); *A47K 13/04* (2013.01); *E03F 9/00* (2013.01)

(58) Field of Classification Search

CPC ..... A47K 13/00; A47K 13/06; A47K 13/08; A47K 13/24; A47K 17/02; E03D 9/00

USPC ..... 4/234, 237, 239, 235, 300.3, 242.1, 4/DIG. 5, 902, 245.7

See application file for complete search history.

(56) References Cited

U.S. PATENT DOCUMENTS

| | | | | |
|---|---|---|---|---|
| 218,894 | A * | 8/1879 | Morrison | 4/479 |
| 654,301 | A * | 7/1900 | Barnes | 4/237 |
| 2,114,551 | A * | 4/1938 | Winding | 4/237 |
| 2,529,587 | A * | 11/1950 | Bates et al. | 4/255.01 |
| 2,751,604 | A * | 6/1956 | Young | 4/237 |
| 2,903,713 | A * | 9/1959 | Previte | 4/245.5 |
| 3,331,085 | A * | 7/1967 | Potosky | 4/245.7 |
| 3,593,349 | A * | 7/1971 | Bungo | 4/237 |
| 3,931,649 | A * | 1/1976 | Jankowski | 4/300.3 |
| 4,716,602 | A * | 1/1988 | Brickhouse | 4/237 |
| 5,388,282 | A * | 2/1995 | Cherry | 4/300 |
| 6,408,447 | B1 * | 6/2002 | Burbank et al. | 4/300.3 |
| 6,513,172 | B1 * | 2/2003 | Norton | 4/300.3 |
| 2005/0138721 | A1 * | 6/2005 | Bowman et al. | 4/234 |
| 2006/0206998 | A1 * | 9/2006 | Corbin | 4/234 |
| 2010/0275354 | A1 * | 11/2010 | McCarthy | 4/237 |
| 2012/0066824 | A1 * | 3/2012 | DeZarn et al. | 4/300.3 |

* cited by examiner

*Primary Examiner* — Lauren Crane
*Assistant Examiner* — Erin Deery

(57) ABSTRACT

A seal for use with a toilet bowl has a horizontal lip with a horizontal ledge beneath the lip. An annular base of the seal is positioned upon the lip. The interior edge of the seal is positioned upon the lip above the interior surface of the toilet bowl. The exterior edge is positioned upon the lip above the exterior surface of the toilet bowl. The central extent of the seal is spaced above the lip. The lower end of an upstanding finger of the seal is integrally formed with the base above the central extent. The upstanding finger has a lower extent in a linear configuration extending outwardly from the vertical.

3 Claims, 4 Drawing Sheets

FIG. 1
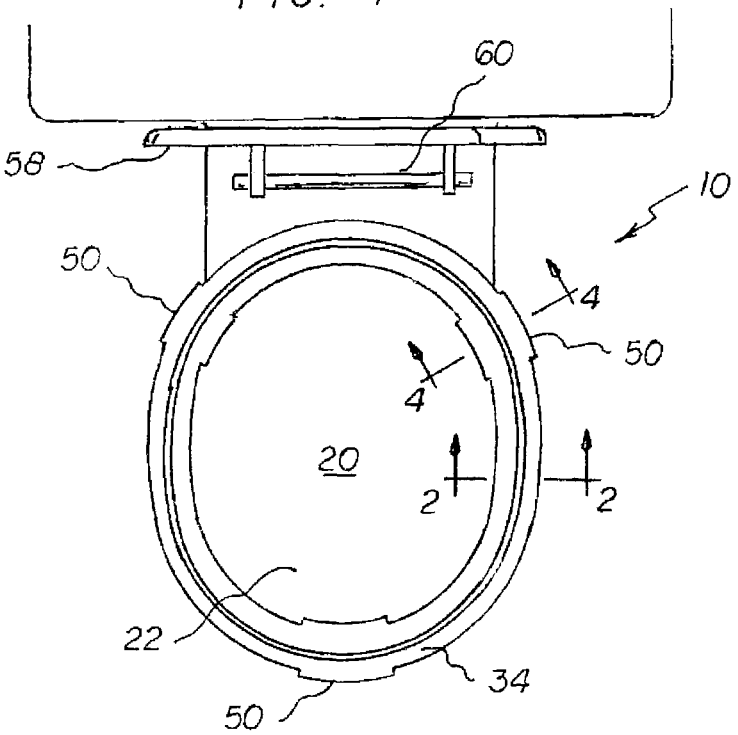
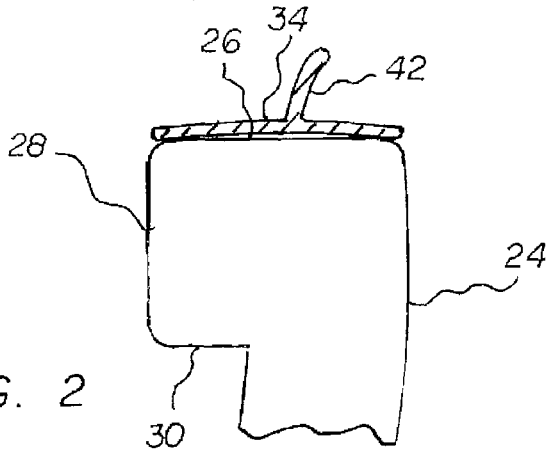
FIG. 2

FIG. 5
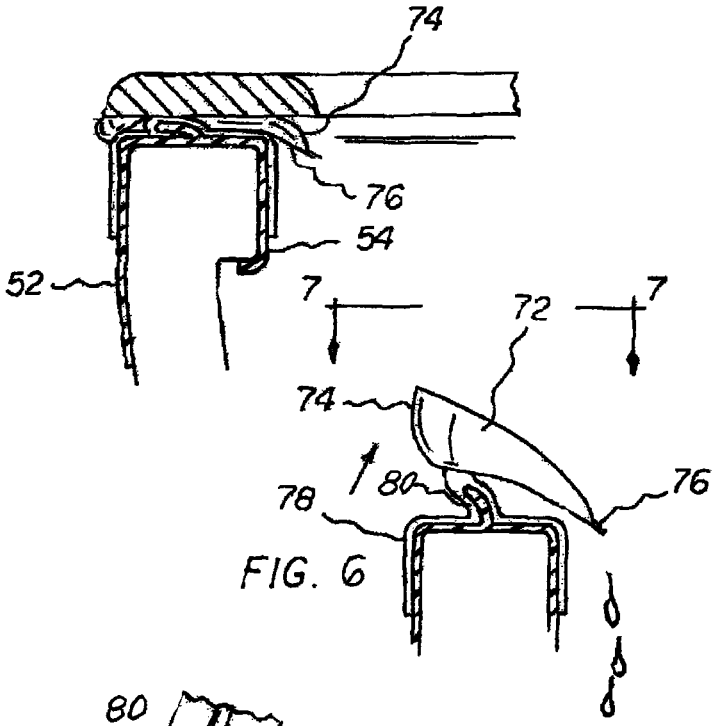
FIG. 6
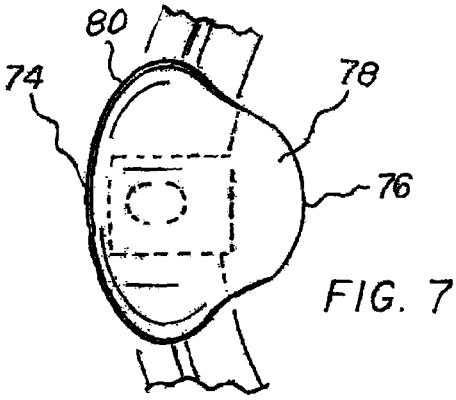
FIG. 7

TOILET SEAL SYSTEM

BACKGROUND OF THE INVENTION

Field of the Invention

The present invention relates to a toilet seal system and more particularly pertains to abating the escape of urine and odor from a toilet and from the space between a toilet bowl and a toilet seat and from the space between the toilet seat and toilet lid, the abating of urine and odor being done in a safe, sanitary, clean and economic manner.

SUMMARY OF THE INVENTION

In view of the foregoing disadvantages inherent in the known types of seal systems of known designs and configurations now present in the prior art, the present invention provides an improved toilet seal system. As such, the general purpose of the present invention, which will be described subsequently in greater detail, is to provide a new and improved toilet seal system and method which has all the advantages of the prior art and none of the disadvantages.

To attain this, the present invention essentially comprises a seal having an annular base positioned upon the lip of a toilet bowl. The seal has an interior edge positioned upon the lip above the interior surface of the toilet bowl. The seal has an exterior edge positioned upon the lip above the exterior surface of the toilet bowl. The seal has a central extent spaced above the lip. The seal has an upstanding finger. The upstanding finger has a lower end integrally formed with the base above the central extent. The upstanding finger has a lower extent in a linear configuration extending outwardly from the vertical.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet seal system which has all of the advantages of the prior art seal systems of known designs and configurations and none of the disadvantages.

It is another object of the present invention to provide a new and improved toilet seal system which may be easily and efficiently manufactured and marketed.

It is further object of the present invention to provide a new and improved toilet seal system which is of durable and reliable constructions.

An even further object of the present invention is to provide a new and improved toilet seal system which is susceptible of a low cost of manufacture with regard to both materials and labor, and which accordingly is then susceptible of low prices of sale to the consuming public, thereby making such toilet seal system economically available to the buying public.

Lastly, another object of the present invention is to provide a toilet seal system for abating the escape of urine and odor from a toilet and from the space between a toilet bowl and a toilet seat and from the space between the toilet seat and toilet lid, the abating of urine and odor being done in a safe, sanitary, clean and economic manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is plan view of a toilet seal system constructed in accordance with the principles of the present invention, the seat and the lid being raised.

FIGS. 2 and 3 are cross sectional views taken along line 2-2 of FIG. 1, FIG. 2 with the seat raised, FIG. 3 with the seat lowered.

FIG. 5 is a cross sectional view of a supplemental urine guard shown with the seat down.

FIG. 6 is a cross sectional view similar to FIG. 5 but with the seat up.

FIG. 7 is a plan view of the urine guard taken along line 7-7 of FIG. 6.

The same reference numerals refer to the same parts throughout the various Figures.

DESCRIPTION OF THE PREFERRED EMBODIMENT

Figure 3:
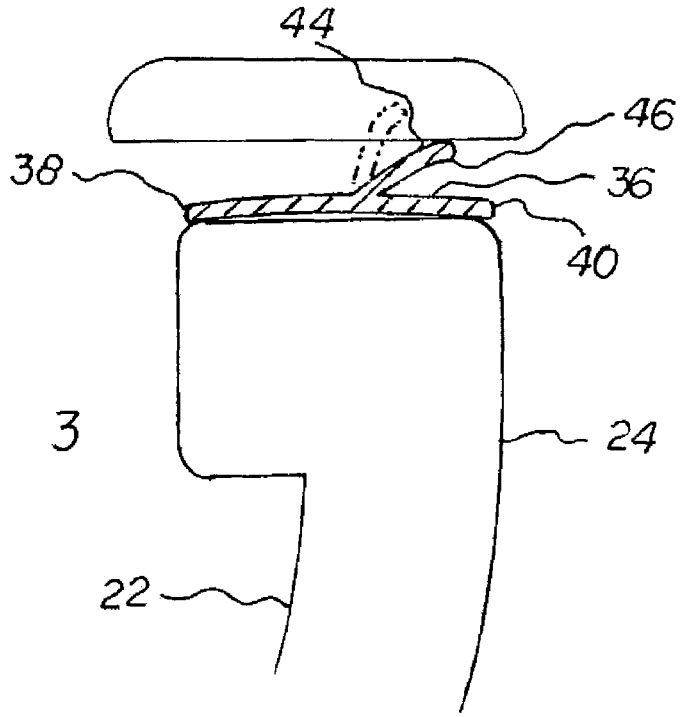
Figure 4:
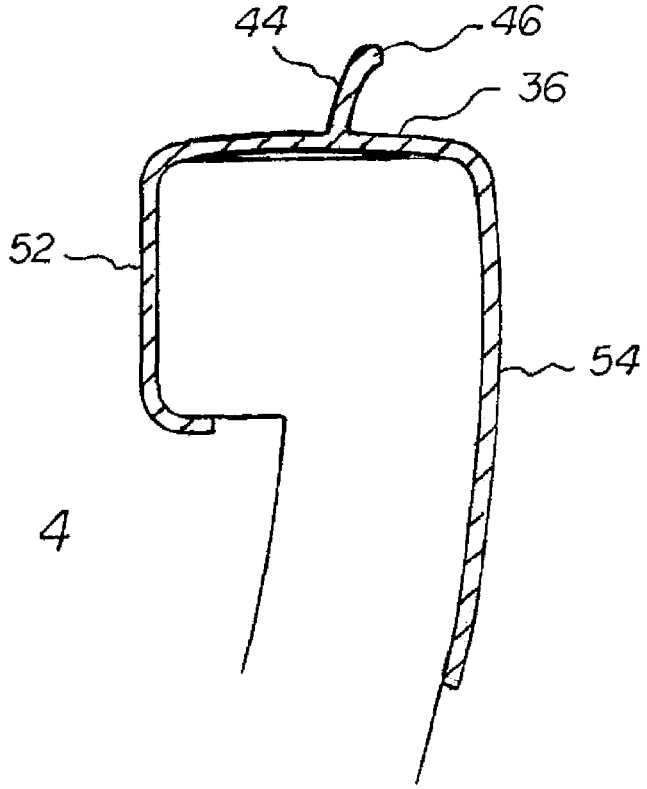
FIG. 4 is a cross sectional view taken along line 4-4 of FIG. 1.
Figure 8:
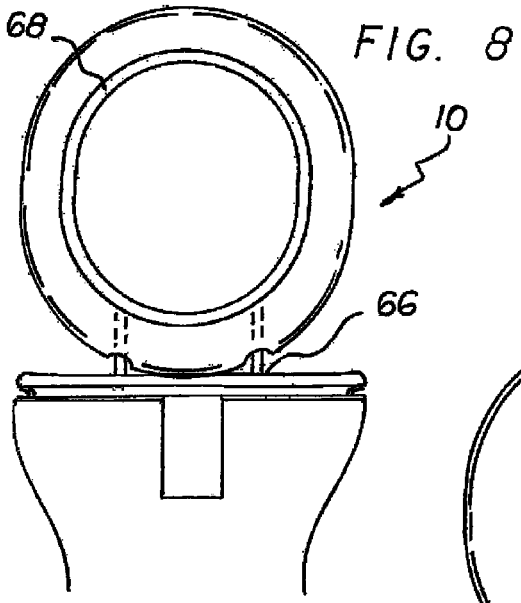
FIG. 8 is a front elevational view of the system with a lid seal.
Figure 9:
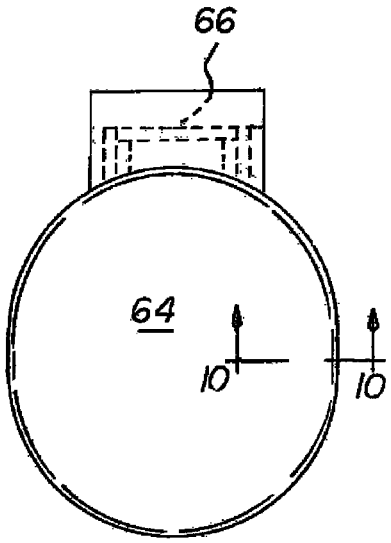
FIG. 9 is a plan view of the system of FIG. 8 but with the lid down.
Figure 10:
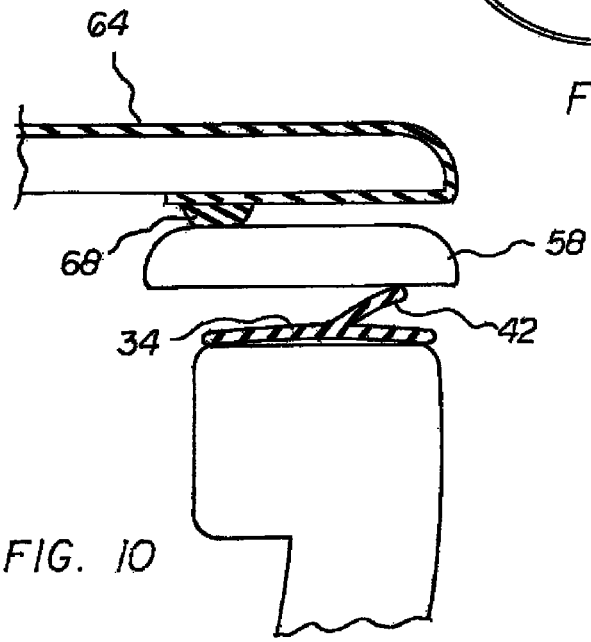
FIG. 10 is a cross sectional view taken along line 10-10 of FIG. 9.

With reference now to the drawings, and in particular to FIG. 1 thereof, the preferred embodiment of the new and improved toilet seal system embodying the principles and concepts of the present invention and generally designated by the reference numeral 10 will be described.

The present invention, the toilet seal system 10 is comprised of a seal. The seal is configured so as to attain the desired objective.

First provided is a toilet bowl 20. The toilet bowl has a generally hemispherical interior surface 22. The toilet bowl has a generally hemispherical exterior surface 24. The exterior surface is larger than the interior surface. The interior and exterior surfaces form a horizontal upper edge 26. The horizontal upper edge is in an annular configuration. The interior and exterior surfaces form a lip 28. The lip has a first thickness. The first thickness is adjacent to the upper edge. The interior and exterior surfaces are provided beneath the lip. The lips has a thin second thickness. The second thickness is less than the first thickness. The interior surface forms a horizontal ledge beneath the lip 30. The toilet bowl is fabricated of a rigid ceramic material.

A seal 34 is provided. The seal has an annular base 36. The base is positioned upon the lip. The seal has an interior edge 38. The interior edge is positioned upon the lip above the interior surface. The seal has an exterior edge 40. The exterior edge is positioned upon the lip above the exterior surface. The seal has a central extent. The central extent is spaced above the lip. The seal has an upstanding finger 42. The upstanding finger has a lower end. The lower end is integrally formed with the base above the central extent. The upstanding finger has a lower extent 44. The lower extent is provided in a linear configuration. The lower extent extends outwardly from the vertical at an angle of less than 15 degrees. The upstanding finger has an upper extent 46. The upper extent extends outwardly from the vertical at an angle of greater than 15 degrees.

Three rotationally spaced coupling projections 50 are provided. The coupling projections are integrally formed with and extend downwardly from the seal. The coupling projections are circumferentially spaced around the lip. Each coupling projection of the three rotationally spaced coupling projections have an inner component 52. The inner components terminate in a horizontal segment. The inner components encompass the lip and a portion of the horizontal ledge. Each coupling projection of the three rotationally spaced coupling projections having an outer component 54. The outer component extends downwardly beneath the horizontal ledge. The seal and the coupling projections are fabricated of an elastomeric material. The elastomeric material has limited flexibility and resilience. The elastomeric material is chosen from the class of elastomeric materials. The class of elastomeric materials includes plastic and rubber, natural and synthetic, and blends thereof.

Provided next is a toilet seat 58. The toilet seat is pivotally coupled to the toilet at a rearward region 60. The toilet seat is movable between a raised position and a lowered position. In the raised position, the toilet seat is provided out of contact with the seal and a lowered position. In this manner the central extent of the base in urged in close proximity to the lip of the toilet. Further in this manner the finger is pointed downwardly and outwardly. Also in this manner any opening between the seat and the toilet are eliminated. Further in this manner odor from the toilet escaping into surrounding environs is abated. In the lowered position, the toilet seat is in contact with the seal.

Further provided is a toilet lid 64. The toilet lid is pivotally coupled to the toilet at the rearward region 66. An annular ring 68 is provided. The annular ring extends downwardly from the toilet lid. The toilet lid is movable between a raised position out of contact with the toilet seat and lowered position with the annular ring in contact with the toilet seat. The annular ring is fabricated of an elastomeric material. The elastomeric material has limited flexibility and resilience. The elastomeric material is chosen from the class of elastomeric materials. The class of elastomeric materials includes plastic and rubber, natural synthetic, and blends thereof. Note is taken that the lid may be raised and lowered without touching the seat. In addition, the seat may be raised and lowered without touching the seal or the toilet bowl.

Provided last is an optional urine guard 72. The urine guard is removably positionable on the toilet bowl and the seat at a forward region. The urine guard is in a generally triangular configuration. The urine guard has a long leg 74. The long leg is provided above the exterior surface. The long leg is provided at an elevated height above the lip of the toilet. The urine guard has an apex 76. The apex is provided adjacent to the interior surface at a height beneath the upper edge of the toilet bowl. In this manner the urine sprayed outwardly by a young male user will enter the urine guard and fall into the toilet. The urine guard has an attachment assembly 78. The attachment assembly extends downwardly. In this manner the lip of the toilet and the forward and rearward extents of the seal are encompassed. The attachment assembly has an upwardly extending recess 80. In this manner the finger of the seal is received. The urine guard is fabricated of an elastomeric material. The elastomeric material has limited flexibility and resilience. The elastomeric material is chosen from the class of elastomeric materials. The class of elastomeric materials includes plastic and rubber, natural and synthetic, and blends thereof. The urine guard is adapted to compress when the seat is lowered to contact the urine guard.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seal system for use with a toilet bowl having interior and exterior surfaces forming a horizontal upper lip with a horizontal ledge beneath the lip, the system comprising:

a seal having an annular base positioned upon the lip, the seal having an interior edge positioned upon the lip above the interior surface, the seal having an exterior edge positioned upon the lip above the exterior surface, the seal having a central extent spaced above the lip, the seal having an upstanding finger with a lower end integrally formed with the base above the central extent, the upstanding finger having a lower region extending upwardly and radially inwardly with respect to the base at a first angle, the upstanding finger having an upper region extending upwardly and radially inwardly with respect to the base at a second angle greater than the first angle; and three rotationally spaced coupling projections integrally formed with and extending downwardly from the seal, the coupling projections being circumferentially spaced around the lip, each coupling projection of the three rotationally spaced coupling projections having an inner component terminating in a horizontal segment and encompassing a portion of the lip and the horizontal ledge, each coupling projection of the three rotationally spaced coupling projections having an outer component extending downwardly beneath the horizontal ledge, the seal and the coupling projections being fabricated of an elastomeric material.

2. The system as set forth in claim 1 and further including:

a urine guard removably positionable on the toilet bowl lip at a forward region, the urine guard having a three sided configuration with a long leg above the exterior surface at an elevated height above the lip of the toilet, the urine guard having an apex adjacent to the interior surface at a height beneath the toilet bowl lip whereby urine sprayed outwardly by a young male user will enter the urine guard and fall into the toilet, the urine guard having an attachment assembly extending downwardly to encompass the lip of the toilet and the forward and rearward extents of the seal, the attachment assembly having an upwardly extending recess for the receipt of the finger of the seal, the urine guard being fabricated of an elastomeric material, the urine guard adapted to compress when the toilet seat is lowered to contact the urine guard.

3. A toilet seal system (10) for abating the escape of urine and odor from a toilet and from the space between a toilet bowl and a toilet seat and from the space between the toilet seat and toilet lid, the abating of urine and odor being done in a safe, sanitary, clean and economic manner, the system comprising:

the toilet bowl (20) having a generally hemispherical interior surface (22) and a generally hemispherical exterior surface (24) larger than the interior surface, the interior and exterior surfaces forming a horizontal upper edge (26) with an annular configuration, the interior and exterior surfaces forming a lip (28) of a first thickness adjacent to the upper edge, the interior and exterior surfaces beneath the lip having a thin second thickness less than the first thickness, the interior surface forming a horizontal ledge beneath the lip (30), the toilet bowl being fabricated of a rigid ceramic material;

a seal (34) having an annular base (36) positioned upon the lip, the seal having an interior edge (38) positioned upon the lip above the interior surface, the seal having an exterior edge (40) positioned upon the lip above the exterior surface, the seal having a central extent spaced above the lip, the seal having an upstanding finger (42) with a lower end integrally formed with the base above the central extent, the upstanding finger having a lower extent (44) in a linear configuration extending outwardly from the vertical at an angle of less than 15 degrees relative to the base, the upstanding finger having an upper extent (46) extending outwardly from the vertical at an angle of greater than 15 degrees relative to the base;

three rotationally spaced coupling projections (50) integrally formed with and extending downwardly from the seal, the coupling projections being circumferentially spaced around the lip, each coupling projection of the three rotationally spaced coupling projections having an inner component (52) terminating in a horizontal segment and encompassing the lip and a portion of the horizontal ledge, each coupling projection of the three rotationally spaced coupling projections having an outer component (54) extending downwardly beneath the horizontal ledge, the seal and the coupling projections being fabricated of an elastomeric material;

a toilet seat (58) pivotally coupled to the toilet at a rearward region (60), the toilet seat movable between a raised position out of contact with the seal and a lowered position in contact with the seal thus urging the central extent of the base in close proximity to the lip of the toilet and pivoting the finger downwardly and outwardly to eliminate any opening between the seat and the toilet for abating odor from the toilet escaping into surrounding environs;

a toilet lid (64) pivotally coupled to the toilet at the rearward region (66), an annular ring (68) extending downwardly from the toilet lid, the toilet lid movable between a raised position out of contact with the toilet seat and a lowered position with the annular ring in contact with the toilet seat, the annular ring being fabricated of an elastomeric material;

an urine guard (72) removably positionable on the toilet bowl and the seat at a forward region, the urine guard having a three sided configuration with a long leg (74) above the exterior surface at an elevated height above the lip of the toilet, the urine guard having an apex (76) adjacent to the interior surface at a height beneath the upper edge of the toilet bowl whereby urine sprayed outwardly by a young male user will enter the urine guard and fall into the toilet, the urine guard having an attachment assembly (78) extending downwardly to encompass the lip of the toilet and the forward and rearward extents of the seal, the attachment assembly having an upwardly extending recess (80) for the receipt of the finger of the seal, the urine guard being fabricated of an elastomeric material, the urine guard adapted to compress when the seat is lowered to contact the urine guard.

* * * * *